US005992321A

United States Patent [19]

Stephan

[11] Patent Number: 5,992,321

[45] Date of Patent: Nov. 30, 1999

[54] DEVICE FOR HOLDING AND TAUTENING CYLINDER PACKINGS ON PRINTING MACHINE CYLINDERS

[75] Inventor: Dieter Stephan, Heidelberg, Germany

[73] Assignee: Heidelberger Druckmaschinen Aktiengesellschaft, Heidelberg, Germany

[21] Appl. No.: 09/026,445

[22] Filed: Feb. 19, 1998

[30] Foreign Application Priority Data

Feb. 19, 1997 [DE] Germany ..... 197 06 435

[51] Int. Cl.[6] ..... B41F 27/12

[52] U.S. Cl. ..... 101/415.1

[58] Field of Search ..... 101/415.1, 409

[56] References Cited

U.S. PATENT DOCUMENTS

| | | | |
|---|---|---|---|
| 2,694,976 | 11/1954 | Huck | 101/415.1 |
| 4,006,686 | 2/1977 | Ackerman | 101/415.1 |
| 4,018,158 | 4/1977 | Borneman | 101/415.1 |
| 5,553,544 | 9/1996 | Ramsay | 101/415.1 |
| 5,685,226 | 11/1997 | Fuller | 101/415.1 |

FOREIGN PATENT DOCUMENTS

| | | |
|---|---|---|
| 609099 | 2/1935 | Germany . |
| 3300678C2 | 4/1988 | Germany . |

*Primary Examiner*—Edgar Burr
*Assistant Examiner*—Leslie J. Grohusky
*Attorney, Agent, or Firm*—Herbert L. Lerner; Laurence A. Greenberg

[57] ABSTRACT

A device for holding and tautening cylinder packings on printing machine cylinders, with at least one tension element whereon a cylinder packing is held, the tension element being pivotable coaxially with the cylinder axis, includes a rotatable lever, a locking device for locking the lever, and a spring member for transmitting a tensioning force to the tension element during a rotational movement of the lever so as to tauten the cylinder packing; and a printing machine including the foregoing device.

18 Claims, 4 Drawing Sheets

DEVICE FOR HOLDING AND TAUTENING CYLINDER PACKINGS ON PRINTING MACHINE CYLINDERS

BACKGROUND OF THE INVENTION

Field of the Invention

The invention relates to a device for holding and tautening cylinder packings on printing machine cylinders, with at least one tension element whereon a cylinder packing is held, the tension element being pivotable coaxially with the cylinder axis, the device of the invention, in particular, clamping metal foils on transfer cylinders of sheet-fed rotary offset printing machines; and a printing machine including the device.

German Patent 33 00 678 discloses a device for holding and tautening or clamping a wrap-round plate on a cylinder for rotogravure or intaglio printing presses, wherein the cylinder packing is tautened or clamped by coaxially pivoting a tension member about the axis of a gravure cylinder. The tension member is driven by a clamping element which is supported between a pivotable and a stationary portion of the cylinder. Due to the arrangement of the clamping element, the pivot angle or angle of traverse of the clamping element in the described tautening or clamping device is greatly restricted, so that edge battens or strips capable of being pivoted out of the outer contour of the cylinder are necessary in order to suspend the end of the cylinder packing.

German Patent 609 099 describes a fastening and tautening or clamping device for flexible printing plates, which has a lever device made up of a double rod or link arranged outside the cylinder and adjustable by a worm gear, and a pivotable batten or strip fastened to a lever arm. Although, with such a clamping device, it is possible to fix the rotary position of the pivoted clamping element in various positions and does not require a component projecting out of the outer contour of the cylinder, the handling and operation of the described clamping device is complicated and laborious, particularly on a cylinder which is installed in the printing machine and to which access is made difficult by adjacent assemblies. The described device does not disclose any means for permitting a rapid pivoting of the clamping element through a larger pivot angle for the purpose of affording favorable access when the cylinder packing is being fastened. There is also no disclosure therein of any springs which ensure that the device has a constant and reproducible tensioning or tautening effect and, in the event of material fatigue and in the case of dimensional deviations of the cylinder packing, have a compensating effect.

SUMMARY OF THE INVENTION

It is accordingly an object of the invention to provide a device for holding and tautening or clamping various types of cylinder packings on printing machine cylinders, which makes it possible for the operator to thus fasten and tauten or clamp a cylinder packing simply and conveniently, thereby always ensuring that the cylinder packings are properly fastened even when tensions in the cylinder packings are varying.

With the foregoing and other objects in view, there is provided, in accordance with one aspect of the invention, a device for holding and tautening cylinder packings on printing machine cylinders, with at least one tension element whereon a cylinder packing is held, the tension element being pivotable coaxially with the cylinder axis, comprising a rotatable lever, a locking device for locking the lever, and a spring member for transmitting a tensioning force to the tension element during a rotational movement of the lever so as to tauten the cylinder packing.

In accordance with another feature of the invention, the device includes another lever for transmitting to the tension element a force necessary for performing at least one of the functions of pivoting the tension element and tautening the cylinder packing.

In accordance with a further feature of the invention, at least one of the rotatable lever and the other lever has a lever axis disposed eccentrically to the cylinder axis.

In accordance with an added feature of the invention, the device includes a rectilinear guide connecting the other lever and the tension element to one another.

In accordance with an additional feature of the invention, the rotatable lever and the other lever are arranged so as to be rotatable relative to one another on a common lever axis.

In accordance with yet another feature of the invention, the spring continually operatively connects the rotatable lever and the other lever to one another.

In accordance with yet a further feature of the invention, the device includes a driver for blocking relative rotation of the rotatable and the other lever beyond a given angular position.

In accordance with yet an added feature of the invention, the spring is held in a prestressed state.

In accordance with yet an additional feature of the invention, the device includes an arcuate guide wherein the tension element is guided.

In accordance with still another feature of the invention, the arcuate guide is a slotted guide having guide tracks running concentrically to the cylinder axis.

In accordance with still a further feature of the invention, at least one guided element is assigned to the tension element and is guidable in the rectilinear guide.

In accordance with an alternative feature of the invention, at least one guided element is assigned to the tension element and is guidable in the arcuate guide.

In accordance with still an added feature of the invention, the locking device comprises a gear mechanism.

In accordance with still an additional feature of the invention, the gear mechanism is a worm gear mechanism formed of a fixed block, a movable block and a spindle for securing the rotatable lever against rotation in a first direction of rotation and permitting the rotatable lever to rotate in a second direction of rotation.

In accordance with another feature of the invention, the tension element is sprung in radial direction relative to the printing machine cylinder.

In accordance with a further feature of the invention, the device includes a spring for keeping the arcuate guide and elements guidable therein in contact with one another on a provided guide face.

In accordance with a concomitant aspect of the invention, there is provided a printing machine having printing machine cylinders, comprising a device for holding and tautening cylinder packings on the printing machine cylinders, with at least one tension element whereon a cylinder packing is held, the tension element being pivotable coaxially with the cylinder axis, a rotatable lever, a locking device for locking the lever, and a spring member for transmitting a tensioning force to the tension element during a rotational movement of the lever so as to tauten the cylinder packing.

According to the invention, the device thus comprises a lever, a spring and a locking device. The lever can be held in a preferred position by the locking device. The spring is arranged relative to the lever in such a manner that a fixed connection or a drive connection can be made between the spring and the lever. In this arrangement, deformation of the spring is produced by a rotational movement of the lever and the clamping force of the spring, the clamping force taking effect at the same time being transmitted to a clamping element.

There is preferably provided, in addition to the first-mentioned lever, another or second lever which transmits to the clamping element the force necessary for pivoting the clamping element and/or necessary for tautening the cylinder packing.

Preferably, the first lever and/or the other or second lever may have a lever axis arranged eccentrically to the cylinder axis. The other lever and the clamping element are preferably connected to one another via a straight or rectilinear guide, so that relative movement becomes possible between the second lever and the clamping element. The first lever and the second lever may advantageously be arranged rotatably relative to one another on a common lever axis. Preferably, the spring is arranged between the first lever and the second lever in such a way that the first lever and the second lever are permanently drive-connected via the spring. In this case, the spring acts as a force-transmitting bridge member. Furthermore, a driver or entrainer may be provided, which blocks rotation of the first lever and the second lever relative to one another beyond a predetermined angular position, so that the spring is held under prestress, and common rotational movements of the first lever and the second lever are possible. In this embodiment of the invention, the angle between the levers remains constant in a first direction of rotation, during rotation opposite to the clamping direction, and essentially constant in the second direction of rotation. Both when there is a permanent drive connection of the levers by the spring acting as a bridge member and when the levers are connected via the spring held under prestress by the driver, the first and the second levers are continually connected operatively. Their may be provision, moreover, for the spring to be arranged between the first lever and the second lever in such a way that the first lever and the second lever can be coupled to one another via the spring which acts as a force-transmitting bridge member. However, the hitherto mentioned spring, which is capable of being coupled to the levers and/or to the clamping element, may also be held under prestress. Thus, for example, a helical spring may be held under prestress in a housing similar to that of a pneumatic compression spring, instead of the gaseous medium. An arcuate guide may be provided for guiding the clamping element and, in particular, the arcuate guide may be formed as a slotted guide with guide faces running concentrically to the cylinder axis. Furthermore, a sliding element which is assigned to the clamping element guided in the arcuate guide and in the straight guide may also be provided. In a further embodiment of the invention, a locking device is formed as a gear mechanism (in particular, as a worm gear mechanism including a fixed block, a movable block and a spindle) which, in a first direction of rotation opposite to the tensioning direction, detains or blocks the first lever in the rotary position thereof, and allows the locked first lever to move in a second direction of rotation corresponding to the tensioning direction.

The device according to the invention is advantageous in many respects: secure mounting of the cylinder packing is achieved by the use of springs which, in contrast with the devices of the prior art, utilize the inherent elasticity of the cylinder packing, a constant and reproducible clamping effect is ensured even when various types of cylinder packing materials, for example, either metal or plastic foils, are mounted. The device according to the invention compensates for varying tensions in the cylinder packing, for example, resulting from expansions caused by material stress and fatigue. The handiness of the device is improved by the principle upon which the invention is based, namely that of subdividing the entire pivoting operation into a pivoting of the clamping element into an easily accessible position, which pivoting makes it easier to fasten the cylinder packing, and into a further pivoting of the clamping element along with an effect which clamps the cylinder packing. Pivoting for the purpose of fastening the cylinder packing takes place smoothly and over an appropriately larger pivot angle, for example, of approximately 15°. From the moment when the cylinder packing rests sufficiently tautly on the circumferential surface of the cylinder, further tautening or tensioning of the cylinder packing can take place only in the case of appreciable deformation of the spring, so that the selected tensioning effect or tension force is determined essentially solely by the spring. Handling is thus not only simplified, but also made more reliable, because errors, for example, due to the operator's lack of practical experience in exchanging cylinder packings, are prevented. Furthermore, the device according to the invention offers the advantage that the width of the channel between the cylinder packing leading edge held on the tension element and the trailing edge held on a stationary or likewise movable portion of the cylinder can be kept comparatively narrow, for example at approximately 1 mm. However, despite these advantages, the construction of the device remains comparatively uncomplicated, because the basic principle can be put into practice in design terms by only a few components which can be manufactured cost-effectively. A further advantage of the device according to the invention is that it can be integrated in a simple manner into previously existing printing machine cylinders.

Other features which are considered as characteristic for the invention are set forth in the appended claims.

Although the invention is illustrated and described herein as embodied in a device for holding and tautening cylinder packings on printing machine cylinders and a printing press including the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
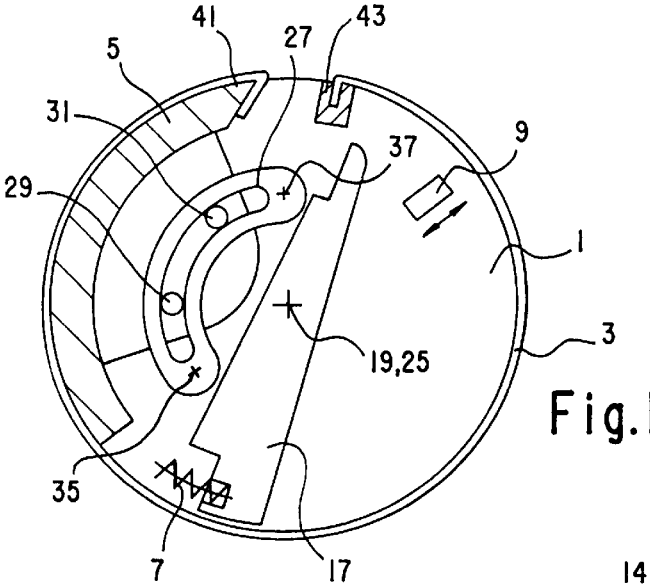
FIG. 1 is a diagrammatic end view of a printing-machine cylinder provided with a first embodiment of the device for holding and tensioning a cylinder packing on the printing-machine cylinder, in accordance with the invention.

Referring now to the drawings and, first, particularly to FIG. 1 thereof, there is shown therein a device for holding and tensioning a cylinder packing 3 on a printing machine cylinder, according to the invention, including a tension element 5 which carries the cylinder packing 3 and which advantageously has a shell-like shape, for example, when a cylinder packing 3 formed of unstable material is to rest, over as full an area as possible, on a closed resting surface. A construction formed of disc elements or lamellae, which is also referred to in the prior art as of a "sandwich type of construction", is expedient in the case of dimensionally stable packing materials, because the mass to be moved can be kept small in contrast with the shell-like construction.

During pivoting of the tension element 5, a non-illustrated comb-like alternate intermeshing of the tension element and the basic body of the cylinder 1 takes place. For this purpose, on shell-like tension elements of compact construction, tine-like recesses may be provided at an edge of the tension element 5 located opposite the leading edge holding the cylinder packing 3, so that the tines or, in the case of a "sandwich type of construction", the lamellae can engage, during pivoting, into correspondingly formed counterpieces of the basic body of the cylinder. Fastening of the end of the first cylinder packing to the pivotable tension element 5 and of the end of the second cylinder packing to a stationary or likewise movable portion of the cylinder may be carried out in various ways. A particularly advantageous embodiment of fastening devices 41, 43 comprises spring rods, bolts and holding springs. Furthermore, there may be provision for constructing the leading edge of the tension element 5 and a correspondingly bent end of the cylinder packing positively relative to one another, a clamping effect which holds the cylinder packing 3 being provided by utilizing the inherent elasticity of the bent cylinder packing material.

The device, furthermore, includes a lockable lever 17 which is rotatable coaxially with the cylinder axis 25.

The tension element 5 may be pivoted by a pivoting drive, a pivoting force being transmitted to the tension element via further components not shown in FIG. 1, such as a further lever, for example. It is also possible, however, to pivot the tension element by hand. For this purpose, appropriate devices, for example, grips or knobs, for better handling may be provided on the tension element.

A spring 7 is fixedly connected to the lever 17 and can be thrown onto the tension element 5 during the tensioning operation. However, provision may just as easily be made for connecting the spring 7 fixedly to the tension element 5 and for throwing the lockable lever 17 onto the spring 7 during the tensioning operation. There may be provision, furthermore, for the spring 7 to be arranged on a further component between the lever 17 and the tension element 5, so that the first lever 17 can be thrown onto the spring 7, and the spring 7 onto the tension element 5.

The locking device 9 may have a very simple construction, for example, in the form of insertable pins, blocking slides or pawls capable of being advanced into the pivoting path of the lever 17. The lever 17 may be laid onto these components during the locking operation, ensuring that the locked lever 17 is at least blocked or detained on one side in its rotary position against undesirable rotational movement in a direction of rotation opposite to the tensioning direction and, therefore, that the lever 17 is fixed in the operating positions.

As shown in FIG. 1, the tension element 5 is preferably guided coaxially with the cylinder axis 25 in an arcuate guide 27. The guide 27 may be a slotted guide for this purpose, with two guide faces running concentrically to the cylinder axis 25 and being arrangeable so as to be offset multiply in the cylinder axis direction, so that, in addition to the position of the tension element 5 being secured radially, it is also secured in position in the cylinder axis direction. The sliding elements 29, 31 of the slotted guide may be sliding pins. Provision may advantageously be made for replacing the sliding guides by roller guides and using ball and roller bearings, respectively, instead of the sliding elements 29, 31. In order to ensure that the slotted guide is oriented coaxially when the device is assembled, the assembly may be performed in a relatively simple manner by utilizing the existing play of the fastening screws 35, 37 (FIG. 1). A further non-illustrated embodiment of the slotted guide involves an interchange of the arrangement of guide faces and sliding elements, so that the guide faces are arranged on the tension element, and the sliding elements are connected to the basic body of the printing machine cylinder. In the case of printing machine cylinders having a supporting surface which is concentric with the outer surface and is offset in the direction of the cylinder axis and on which the tension element at least partially rests or slides, groove-like recesses or perforations resembling slots and slits, respectively, may be incorporated into this supporting surface, and a tension element equipped with sliding elements held form-lockingly, i.e., positively, in the recesses or perforations may thus be guided and held securely in position. In this regard, it is noted that a form-locking connection is one which connects two elements together due to the shape of the elements themselves, as opposed to a force-locking connection, which locks the elements together by force external to the elements.

In the embodiment shown in FIG. 1, the spring 7 acts as a compression spring during the tensioning operation. Various types of springs may be used for this function, such as, for example, the helical spring illustrated or a spring element made from an elastic synthetic or plastic material having a low compression deformation residue, for example, from polyurethane, or else pneumatic compression springs or cup springs. The embodiment shown in FIG. 1 further has a lever axis 19.

Figure 2:
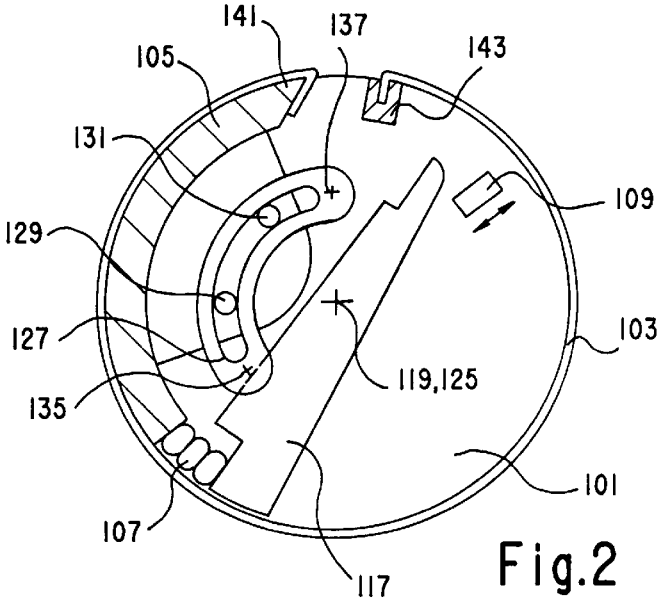
FIG. 2 is a view like that of FIG. 1 of a second embodiment of the device according to the invention provided with a spring formed of elastic synthetic or plastic material and capable of being subjected to tensile and compressive loads.

FIG. 2 illustrates an embodiment of the invention wherein the spring 107 fixedly connects the lever 117 and the tension element 105 to one another. The spring 107 is advantageously formed of elastic synthetic or plastic material. The force for the pivoting movement of the tension element 105 and the force for tensioning the cylinder packing 103 may be exerted by tools. A favorable embodiment has a shaft stub of the lever axis 119 of the lever 117, the shaft stub being accessible outside the printing machine cylinder 101 and preferably having a square or hexagonal cross section, so that standardized tools can be slipped onto this shaft stub. It is thereby possible to transmit a sufficiently high torque to the device not only for pivoting the tension element 105, but also for tensioning the cylinder packing 103. FIG. 2 further shows a locking device 109, a cylinder axis 125, an arcuate guide 127, sliding elements 129, 131, and fastening devices 141, 143. Fastening screws 135, 137 are illustrated diagrammatically.

Figure 3:
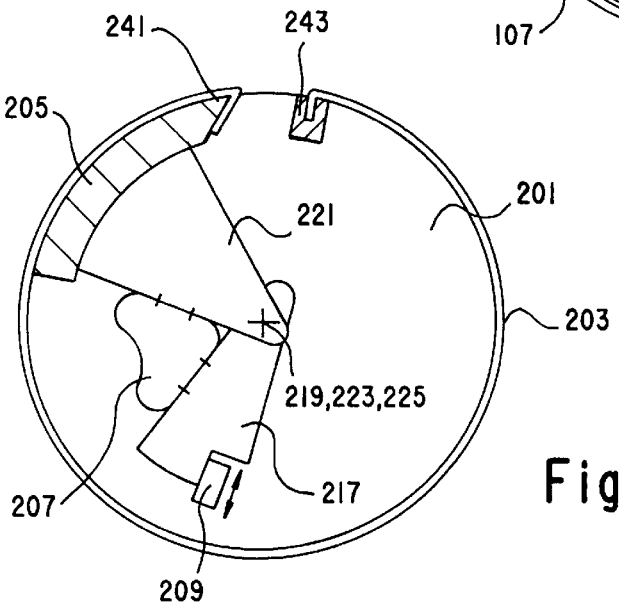
FIG. 3 is a view like those of FIGS. 1 and 2 of a third embodiment of the invention, wherein a lockable first lever and a second lever guiding a tensioning element are arranged on a common lever axis.

A further embodiment shown in FIG. 3 contains, in addition to the lockable first lever 217 (hereinafter referred to as the first lever), another lever 221 (hereinafter referred to as the second lever) which performs the function of guiding the tension element 205 coaxially relative to the cylinder axis 225. By the second lever 221, there is also meant a connecting element which extends radially from the cylinder axis 225 to the tension element 205 and which may, for example, be constructed in the form of a sector of a circle, a tension element which is connected fixedly to a lever formed in this manner also being referred to in the prior art as a tension segment. The spring 207, for example, constructed as a polyurethane spring element, may be arranged between the first lever 217 and the second lever 221, being supported, as shown, on the lever arms and being fixedly connected to the levers 217, 221. However, in a further non-illustrated embodiment, there may just as well be provision for constructing the spring as a torsion spring, for example, as a torsion bar spring, or as a helical spring which is wound round a common lever axis of the levers, and the lengthened turn ends thereof being supported on the lever arms. As already described hereinbefore, in the device shown, the pivoting force and the tension force necessary for tensioning the cylinder packing 203 or necessary for deforming the spring 207 may be transmitted to the lockable first lever 217 by tools via the lever axis 219 of the lever which is form-lockingly or positively connected, for example, pinned, with respect to the lever axis 219. The forces are transmitted from the first lever 217 to the spring 207 which functions as a bridge member connecting the levers 217 and 221. The spring 207 transmits the forces to the second lever 221 which is mounted so as to be rotatable relative to the common lever axis 219, 223 and therefore to the first lever 217. FIG. 3 further shows a printing machine cylinder 201, a locking device 209, and fastening devices 241, 243.

Figure 4:
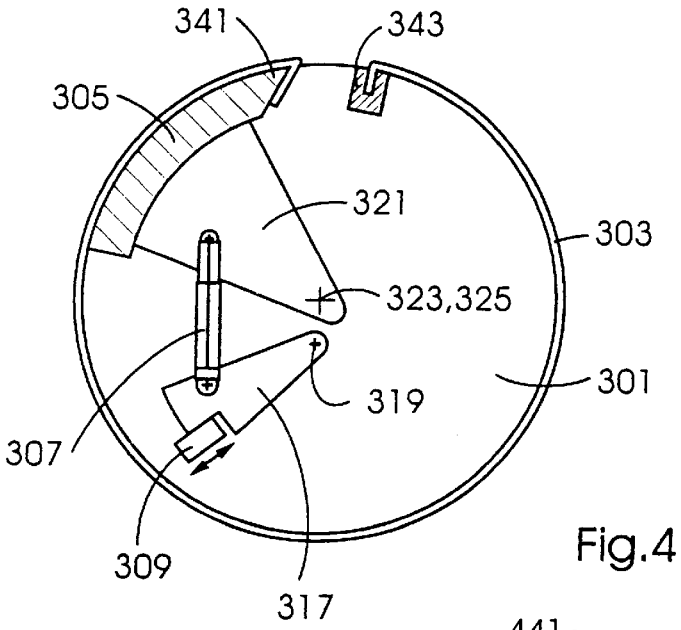
FIG. 4 is a view like those of the preceding figures of a fourth embodiment of the invention, wherein the first lever is arranged on a lever axis eccentric to the cylinder axis, and the spring is formed as a pneumatic compression element.

FIG. 4 illustrates an embodiment of the inventive device wherein the lockable first lever 317 is arranged on a lever axis 319, and the second lever 321 is arranged on another lever axis 323. The lever axis 323 of the second lever 321 coincides with the cylinder axis 325, and the lever axis 319 of the first lever 317 lies offset eccentrically relative to the cylinder axis 325. The spring 307 in this embodiment is formed, for example, as a pneumatic compression spring. FIG. 4 further shows a printing machine cylinder 301, a cylinder packing 303, a tension element 305, a locking device 309, and fastening devices 341, 343.

Figure 5:
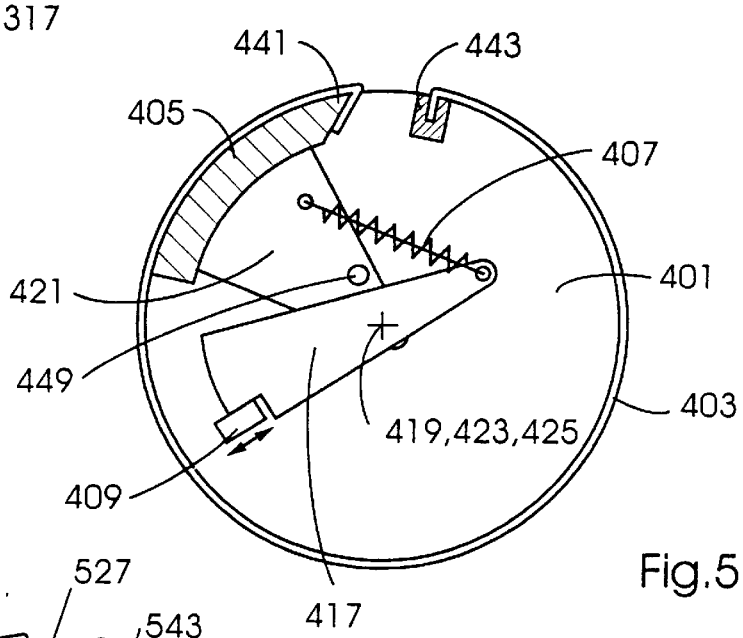
FIG. 5 is a view like those of the preceding figures of a fifth embodiment of the invention, wherein the spring is a tension spring prestressed or preloaded by an entrainer or driver.

FIG. 5 illustrates an embodiment of the invention provided with a spring 407 acting as a tension spring during the tensioning of the cylinder packing 403. A driver or entrainer 449 constructed as a pin permits common movement of the levers 417 and 421 opposite to the tensioning direction. As shown in FIG. 5, the first lever 417 may be constructed so as to be lengthened beyond the lever axis 419 or to be a two-armed lever or bellcrank, and the spring 407 may be arranged between the second lever arm of the first lever 417 and the one-armed second lever 421. There may also be provision, however, for the second lever to have a two-armed or bellcrank construction and for the spring 407 to be arranged between the second lever arm of the latter and the one-armed lockable first lever. FIG. 5 further shows a printing machine cylinder 401, a tension element 405, a locking device 409, a lever axis 423 of the second lever 421, a cylinder axis 425, and fastening devices 441, 443.

Figure 6:
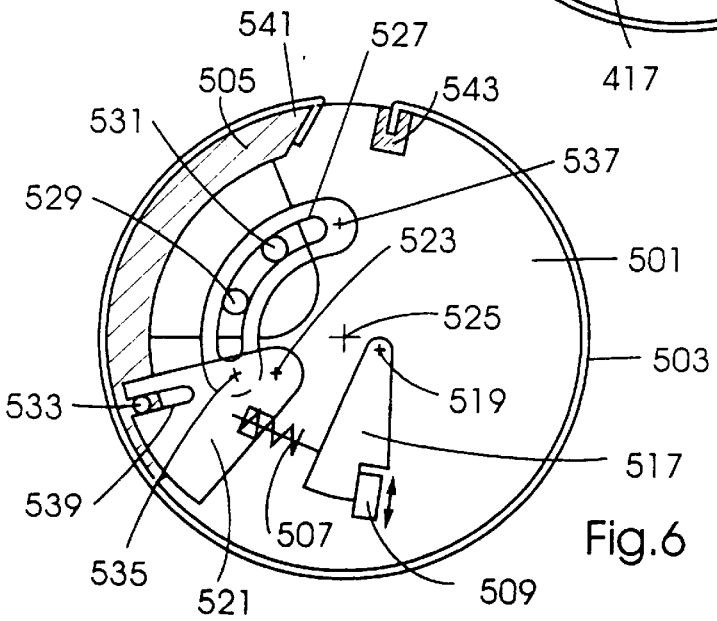
FIG. 6 is a view like those of the preceding figures of a sixth embodiment of the invention, wherein the levers can be drive-coupled to one another, and the second lever is connected to the tension element via a rectilinear guide.

FIG. 6 illustrates a further embodiment of the invention wherein a second lever 521 is provided, which transmits to the tension element 505 the forces necessary for pivoting the tension element 505 and necessary for tensioning the cylinder packing 503. The second lever 521 is arranged on a lever axis 523 disposed eccentrically to the cylinder axis 525. A rectilinear or straight guide 539, for example, formed as a slotted guide, is provided, so that relative movement becomes possible between the second lever 521 and the tension element 505, a positive or form-locking drive connection between the second lever 521 and the tension element 505 being ensured for effecting force transmission. The tension element 505 may be guided by arcuate guide 527. FIG. 6 further shows a printing machine cylinder 501, a spring 507, a locking device 509, a first lever 517, a lever axis 519 of the first lever 517, sliding element 529, 531, 533, fastening screws 535, 537, which are shown only diagrammatically, and fastening devices 541, 543.

Figure 7:
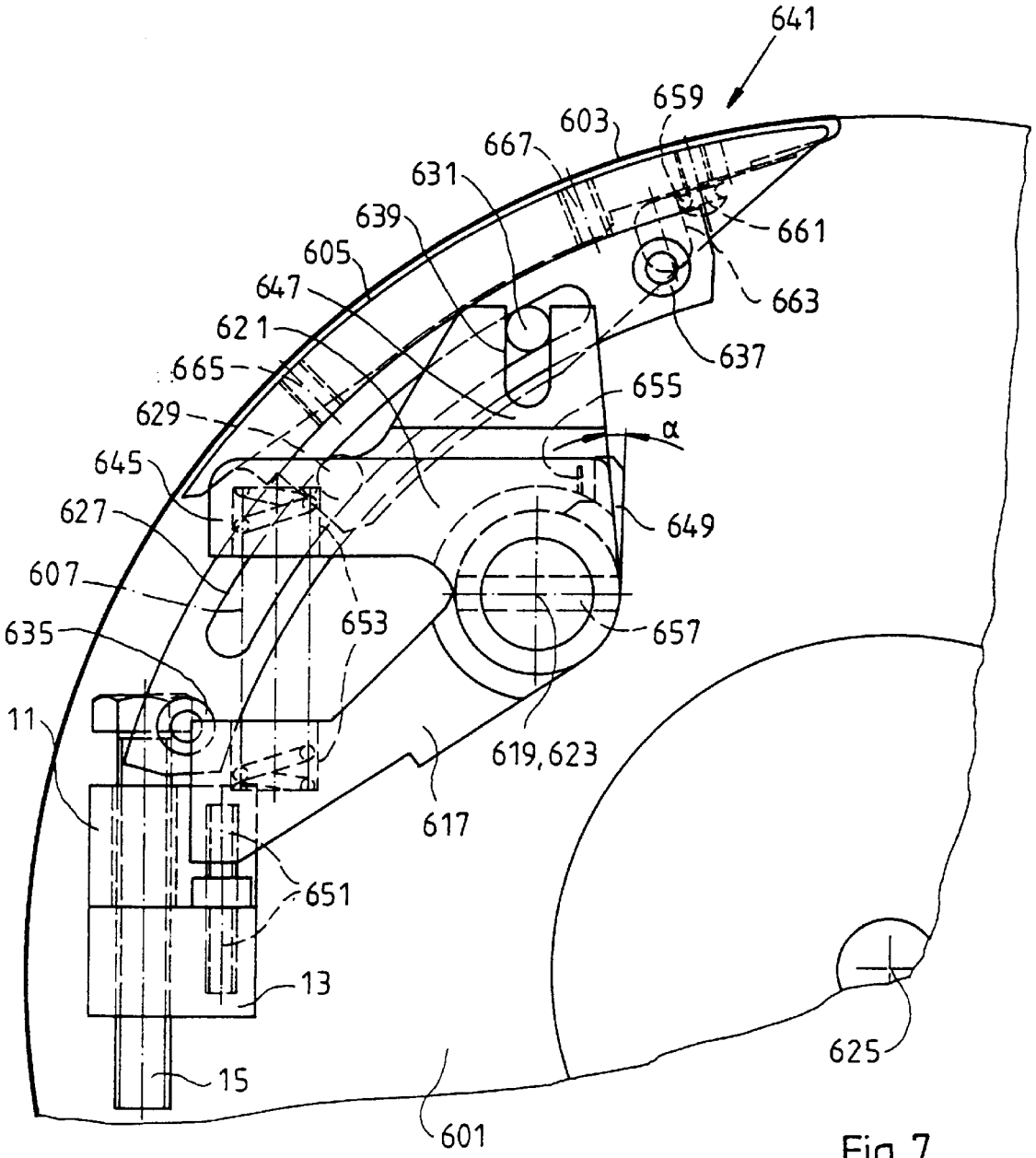
FIG. 7 is an enlarged fragmentary view of one of the preceding figures illustrating a particularly advantageous seventh embodiment of the device according to the invention which includes a locking device formed as a gear.

FIG. 7 illustrates a particularly advantageous embodiment of the device according to the invention for holding and tensioning or tautening cylinder packings on printing machine cylinders, which includes a lockable first lever 617 and a second lever 621 transmitting both the pivoting force and the tension force. The levers 617 and 621 are arranged so as to be rotatable relative to one another on a common lever axis 619, 623 arranged eccentrically to the cylinder axis 625. The lockable first lever 617 is connected so as to be fixed against rotation relative to the lever axis 619, 623 via a connecting member 657, for example, a pin. The second lever 621 may advantageously be of two-armed or bellcrank construction, and a spring 607 may be supported on a first lever arm 645 and a straight or rectilinear guide 639 constructed on a second lever arm 647. It is advantageous if the lever arms 645 and 647 are in a position approximately perpendicularly to one another. The spring 607, for example, a helical spring, acting as a compression spring during the tensioning of the cylinder packing 603, may be supported on the levers 617 and 621 and is, in this case, received and stabilized by recesses 653 formed in the levers 617 and 621. The spring 607 may be held under prestressing or preloading. A driver or entrainer 649 may be provided for this purpose, and may be constructed, for example, as a second short lever arm of the first lever 617. The driver 649 limits relative rotation of the lever 617, 621 by butting onto an appropriately formed counterpiece, for example, a surface of the second lever 621. The levers 617 and 621 can rotate relative to one another counter to an increasing counterforce of the spring 607, the counterforce being above the prestress or load; a deformation of the spring 607 thus occurs. As a rule, for the function of tensioning the cylinder packing 603, it is necessary only to have a rotation of the second lever 621 relative to the first lever 617 over a comparatively small angle of rotation, for example, a few degrees, depending upon the hardness of the spring that is used, and a resulting small relative angle of rotation α of the driver in relation to the lever arm 647 or to the abutment face 655. A second function of the driver or entrainer 649 is to ensure a quick and reliable release of the mounting of the cylinder packing 603, which may possibly adhere to the circumferential surface of the printing machine cylinder 601. The driver or entrainer 649 thus also makes it possible to use a spring 607 capable of being subjected to a compressive load instead of a spring capable of being subjected to tensile and compressive loads. The illustrated arrangement of the prestressed spring 607 and of the driver 649 permits a common rotation of the levers 617 and 621 into specific operating positions, the rotation being capable of being driven via the common lever axis 619, 623 and the first lever 617 mounted thereon so as to be fixed against rotation relative thereto. The pivoting force is transmitted from the first lever 617 to the second lever 621 via the spring 607 functioning as a bridge member, during the pivoting of the tension element 605 in the tensioning direction, and via the driver 649, during the pivoting opposite to the tensioning direction. The locking device is constructed as a worm gear formed of a fixed block 11 attached to the printing machine cylinder 601, a spindle 15, for example, a worm or screw, guided by the fixed block 11, and a movable block 13 capable of being driven by the spindle 15. The locking device 11, 13, 15 is opened by rotating the spindle 15 in a first direction of rotation, the movable block 13 being moved into a position wherein the first lever's end piece, which is to be locked, can be pivoted past the movable block 13 in the tensioning direction. A surface may be provided on the movable block 13 whereon the lever end piece of the first lever 617 is laid during locking. To adjust the exact position of the first lever 617 to be laid in place, an adjusting member 651 may be provided, which is assigned to the locking device or to the first lever 617 to be locked. In the case of the worm gear mechanism 11, 13, 15 shown in FIG. 7, an adjusting screw may advantageously be arranged on the movable block 13.

Further adjusting and setting devices, respectively, which are not shown in the figures, may be provided for adjusting the spring travel or for setting the effective force of the spring. The thread pitch of the worm gear mechanism 11, 13, 15 is advantageously selected in such a manner that a self-locking effect exists. Another embodiment of the locking device not shown in the figures provides an eccentric mechanism. The first lever to be locked rests on an eccentric element, during the rotation of which about an eccentric axis, the first lever is rotated about its lever axis. A worm wheel arranged on the eccentric axis and connected positively to the eccentric is in engagement with a worm serving for the drive. This mechanism is therefore likewise self-locking. The first lever to be locked may be laid directly onto the eccentric element or onto detaining or blocking elements, for example, bolts and pawls, capable of being advanced into the lever pivoting path and mounted on the eccentric. In the preferred embodiment illustrated in FIG. 7, a sliding element 631 is provided, which is assigned to the tension element 605 and combined both with the arcuate guide 627 and the straight or rectilinear guide 639.

The cylinder packing 603 may be fastened to the tension element 605 by spring rods 659, bolts 661 and retaining springs 663. The spring rod 659 is attached to that end of the cylinder packing 603 to be fastened and extends over the width of the cylinder packing. A plurality of bolts 661 are attached to the tension element 605 over the entire width, the spring rod 659 together with the cylinder packing 603 being suspended in the bolts. Recesses, through which the bolts 661 engage, are provided in the edge region of the cylinder packing 603. Retaining springs 663 assigned to the bolts 661 serve for securing the spring rod 659 against being unhooked, the springs holding the spring rod 659 in flute-like recesses on the circumference of the bolts 661. FIG. 7 further shows a sliding element 629, fastening screws 635, 637 (diagrammatically shown), and a fastening device 641.

Figure 8:
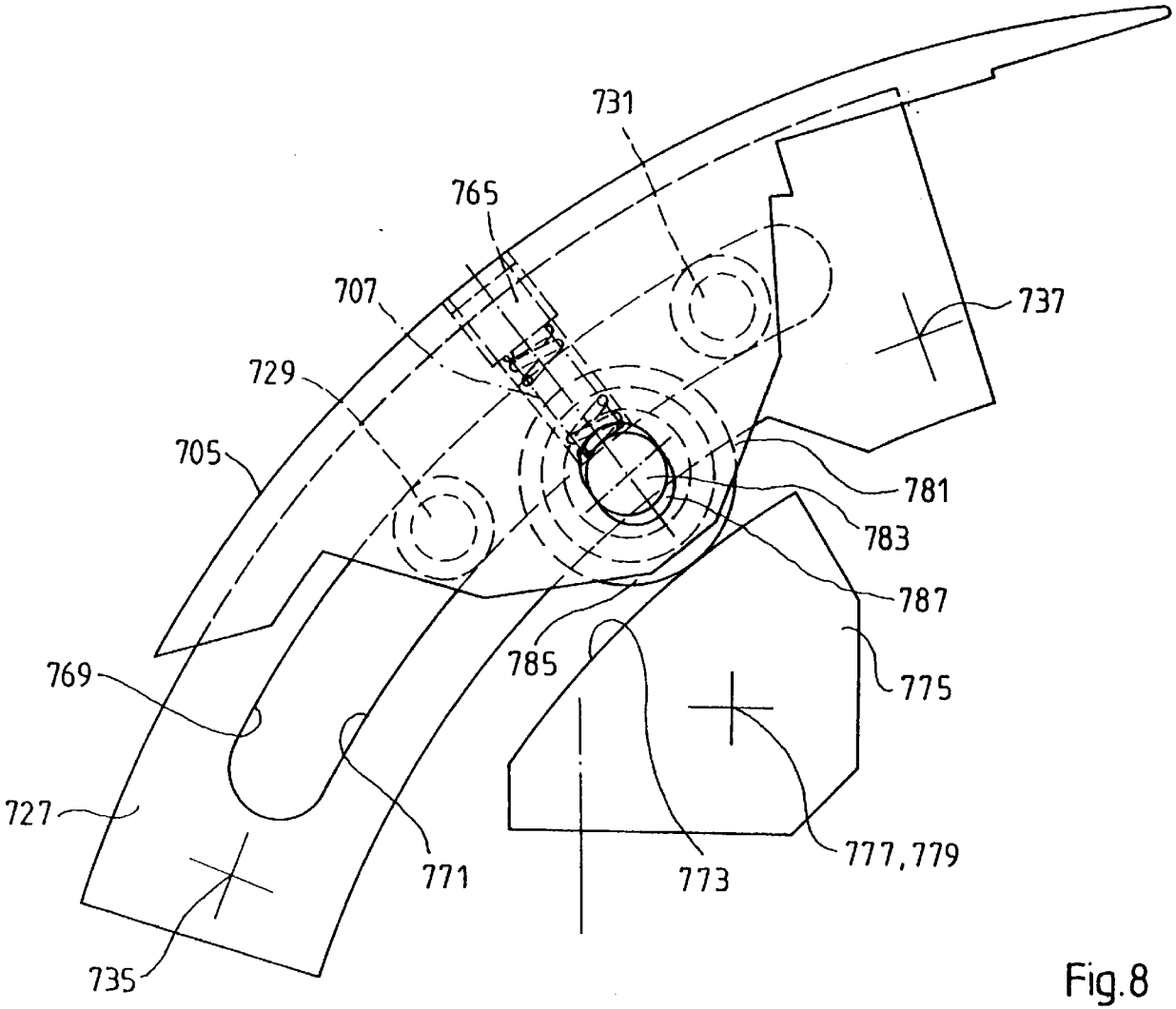
FIG. 8 is another enlarged fragmentary view of one of the preceding figures illustrating a particularly advantageous eighth embodiment of the device according to the invention wherein the tension element is guided in a sprung manner.

A further particularly advantageous embodiment of the device according to the invention is shown in FIG. 8. The tension element 705 is guided in a sprung manner, so that the device is protected from damage, for example, as a result of any double sheets. At the same time, reliable guidance of the roller and rolling elements, respectively, for example, ball bearings 729, 731, on the radially outer preferred guide track 769, is ensured. In principle, this may be achieved by arranging a spring 707 which acts radially relative to the cylinder between the roller or rolling element 729, 731 arranged on the tension element 705 and the arcuate guide 727 arranged on the impression cylinder. If the arrangement is interchanged, the arcuate guide being arranged on the tension element, and the roller or rolling elements being arranged on the printing machine cylinder, the roller or rolling elements would be guided on the inner guide track 771. A preferred structural variation shown in FIG. 8 contains a tension element 705 which has two fork arms 781 extending parallel to one another in the radial direction, a long hole or slot 787 being formed in each of the two fork arms 781, the long holes or slots serving for mounting and guiding a bolt 783 parallel to the cylinder axis. The bolt 783 carries at least one roller element, for example, a ball bearing 785. The ball bearing 785 can roll on a guide track 773 which is coaxial with the cylinder axis and which may be formed on a part 775 fixed against rotation relative to the cylinder. At least one spring 707, for example, a helical spring, is supported on the bolt 783 and is held between the bolt 783 and the tension element 705 under a prestress or preload capable of being set by the adjusting device 765. The long holes or slots 787 permit the tension element 705 to move aside in the radial direction under extreme external action. The spring 707 must be dimensioned, in terms of the effect thereof, in such a manner that no appreciable deformation thereof can occur during the tensioning operation as a result of the tension forces acting upon the tension element, and the tension element is not moved out of the predetermined position. In a further variation in the embodiments of the invention, sprung thrust pieces, acting as a compression spring, or bolts with a sprung ball may be provided instead of the adjusting device 665, 667 (FIG. 7), the thrust pieces and balls, respectively, sliding and rolling on the outer contour of the arcuate guide. Another variation in the construction of the device according to the invention, at least one further roller and rolling element, respectively, is provided which is guided on the radially inner guide track 771, the spring 707 acting as a compression spring or flexural spring, for example, constructed as leaf spring assemblies, between the roller or rolling element, on the one hand, and the tension element, on the other hand. Furthermore, a spring, specifically acting as a tension spring between the tension element and the arcuate guide may also be provided, the spring ensuring permanent contact between the roller and rolling elements, respectively, and the radially inner guide track 771. FIG. 8 further illustrates in a diagrammatic manner fastening screws 735, 737, and fastening devices 777, 779 for fastening the part 775 fixed against rotation relative to the cylinder.

I claim:

1. A device for holding and tautening cylinder packings on printing machine cylinders, with at least one tension element whereon a cylinder packing is held, the tension element being pivotable coaxially with the cylinder axis, comprising a rotatable lever, a locking device for locking said lever, and a spring member for transmitting a tensioning force to the tension element during a rotational movement of said lever so as to tauten the cylinder packing.

2. The device according to claim 1, including another lever for transmitting to the tension element a force necessary for performing at least one of the functions of pivoting the tension element and tautening the cylinder packing.

3. The device according to claim 2, wherein at least one of said rotatable lever and said other lever has a lever axis disposed eccentrically to the cylinder axis.

4. The device according to claim 3, including a rectilinear guide connecting said other lever and the tension element to one another.

5. The device according to claim 4, wherein at least one guided element is assigned to the tension element and is guidable in said rectilinear guide.

6. The device according to claim 2, wherein said member continually operatively connects said rotatable lever and said other lever to one another.

7. The device according to claim 6, including a driver for blocking relative rotation of said rotatable and said other lever beyond a given angular position.

8. The device according to claim 6, wherein said member is held in a prestressed state.

9. The device according to claim 2, wherein said rotatable lever and said other lever are arranged so as to be rotatable relative to one another on a common lever axis.

10. The device according to claim 2, wherein said tension element is a guided tension element, and further including an arcuate guide, a rectilinear guide connecting said other lever and said guided tension element, and at least one guided element assigned to said guided tension element and guidable in said arcuate guide and in said rectilinear guide.

11. The device according to claim 1, including an arcuate guide wherein the tension element is guided.

12. The device according to claim 11 wherein at least one guided element is assigned to the tension element and is guidable in said arcuate guide.

13. The device according to claim 11, wherein said arcuate guide is a slotted guide having guide tracks running concentrically to the cylinder axis.

14. The device according to claim 11, including another spring member for keeping said arcuate guide and elements guidable therein in contact with one another on a preferred guide track.

15. The device according to claim 1, wherein the tension element is sprung in radial direction relative to the printing machine cylinder.

16. The device according to claim 1, wherein said locking device comprises a gear mechanism.

17. The device according to claim 16, wherein said gear mechanism is a worm gear mechanism formed of a fixed block, a movable block and a spindle for securing said rotatable lever against rotation in a first direction of rotation and permitting said rotatable lever to rotate in a second direction of rotation.

18. A printing machine having printing machine cylinders, comprising a device for holding and tautening cylinder packings on the printing machine cylinders, with at least one tension element whereon a cylinder packing is held, said tension element being pivotable coaxially with the cylinder axis, a rotatable lever, a locking device for locking said lever, and a spring member for transmitting a tensioning force to said tension element during a rotational movement of said lever so as to tauten the cylinder packing.

* * * * *